United States Patent [19]

Schermutzki

[11] Patent Number: 4,748,907

[45] Date of Patent: Jun. 7, 1988

[54] GUIDE CHAIN FOR THE ROLLS OF A DUAL BELT PRESS

[75] Inventor: Konrad Schermutzki, Remseck, Fed. Rep. of Germany

[73] Assignee: Santrade Ltd., Luzern, Switzerland

[21] Appl. No.: 106,397

[22] Filed: Oct. 9, 1987

[30] Foreign Application Priority Data

Oct. 22, 1986 [DE] Fed. Rep. of Germany ..... 3635827

[51] Int. Cl.[4] ..... B30B 5/06

[52] U.S. Cl. ..... 100/153; 198/779; 198/834; 425/371

[58] Field of Search ..... 100/151, 153, 154, 118–120; 198/628, 779; 425/371, 370; 198/834; 474/202, 206

[56] References Cited

U.S. PATENT DOCUMENTS 3,701,413 10/1972 Leahy et al. ..... 198/779
4,142,625 3/1979 Bourgeois ..... 198/779 X
4,334,468 6/1982 Guttinger et al. ..... 100/153 X
4,449,448 5/1984 Stabler et al. .

FOREIGN PATENT DOCUMENTS 3140548 3/1983 Fed. Rep. of Germany .
3152911 5/1985 Fed. Rep. of Germany .
3432548 2/1986 Fed. Rep. of Germany .

*Primary Examiner*—Andrew M. Falik
*Attorney, Agent, or Firm*—Burns, Doane, Swecker & Mathis

[57] ABSTRACT

In a dual belt press, the press belts are supported at each end by a first chain. The first chain includes spaced links through which a stud projects. A sleeve is mounted on each stud between the spaced links. The outer circumferences of adjacently disposed sleeves abut one another to prevent lateral displacement of the studs and rolls. A second chain is connected to the studs and is adapted to be driven in order to displace the rolls along a press zone of the press.

9 Claims, 2 Drawing Sheets

GUIDE CHAIN FOR THE ROLLS OF A DUAL BELT PRESS

BACKGROUND AND OBJECTS OF THE INVENTION

The invention concerns a dual belt press of the type in which a material is compressed between a pair of moving belts. The belts are supported on rolls which are carried by guide chains.

Guide chains of this type are known. They primarily serve to guide the parallel rolls disposed between one press belt of the dual belt press and the associated press plate. The forces appearing in the press zone between the moving press belt and the rolls may be very large and thus the rolls are entrained in this press zone by the moving belt. It is necessary that the rolls be maintained as parallel to each other as possible and exactly perpendicular to the direction of travel of the belt, in order to prevent the rolls from slipping out of the press zone. Arrangements have been proposed (e.g., see German Published Application No. 34 32 548-C2), wherein the parallel rolls in the press zone are somewhat freely carried by the guide chains, which is achieved in that the studs guiding the rolls are carried with clearance in the lateral chain link plates. In an arrangement of this type, care must be taken that there occurs no skewing of the rolls in the press zone. Consequently, relatively stable chain links are provided for the guidance of the roll studs, which links travel in separate guides.

The roll guides according to German Published Application No. 31 40 548-C1 also comprise stable chain links. Roll bearings are located in an area offset relative to the plane of the chains, whereby it is possible to arrange several rolls with smaller diameters adjacent to each other, without having to dimension the chain links narrower.

However, all of the conventional forms of the guide chains exhibit the disadvantage that the chain links have an unavoidable inherent play due to manufacturing tolerances, which in actual operation may be enlarged further by the forces generated. A stable lateral guidance of the rolls in the press zone thus cannot be assured with the known configurations. It is the object of the invention to eliminate this problem.

SUMMARY OF THE INVENTION

The present invention involves a dual belt press of the type wherein each belt is supported by a plurality of rolls. The rolls are supported by a first chain which includes spaced chain links. A stud passes through the chain links and is operably connected to an associated roll. A sleeve is disposed on the stud between the chain links. Adjacently disposed ones of the sleeves contact one another at their circumferences. A second chain is operably connected to the first chain for transmitting driving forces to the rolls.

Thus, a roll supporting mechanism is provided whereby the rolls associated with the chain studs are secured and guided at both ends without play by a chain. The drive of the rolls is effected by means of a separate chain, preferably having smaller dimensions. By means of the sleeves disposed on the chain studs, which sleeves are abutting against each other, an angular shifting (skewing) of the rolls relative to each other is prevented. The chains located at either end of the rolls provide stable guide elements, which guide the rolls through the press zone. The wear of the chain by the forces generated during operation are reduced because the tilting or bending of the link plates and the deflection of the guide bores in the link plates associated with it, are prevented by the abutting of the sleeves against each other in the pressing zone of the belts. These sleeves may be formed of a hardened material so as to be wear resistant. The novel guide chains thus have a longer life, which is of advantage in the operation of a dual belt press, as the downtimes needed for the replacement of the roll chains will be considerably shortened.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
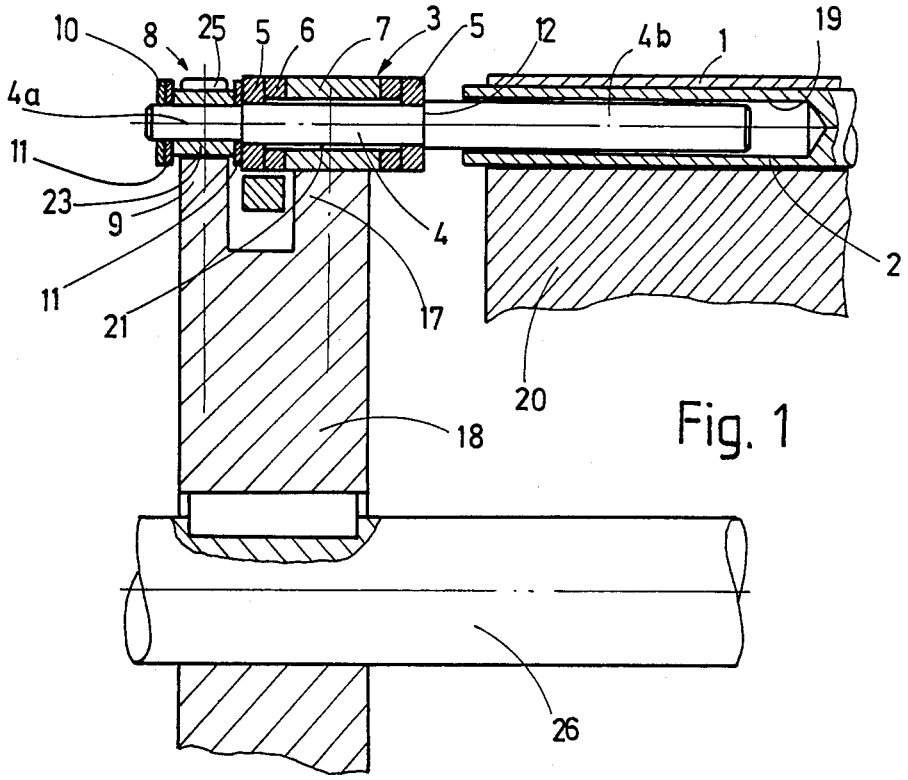
FIG. 1 is a fragmentary sectional view through one of the two guide chains for the belt support rolls of a dual belt press, taken in the pressing zone.
Figure 2:
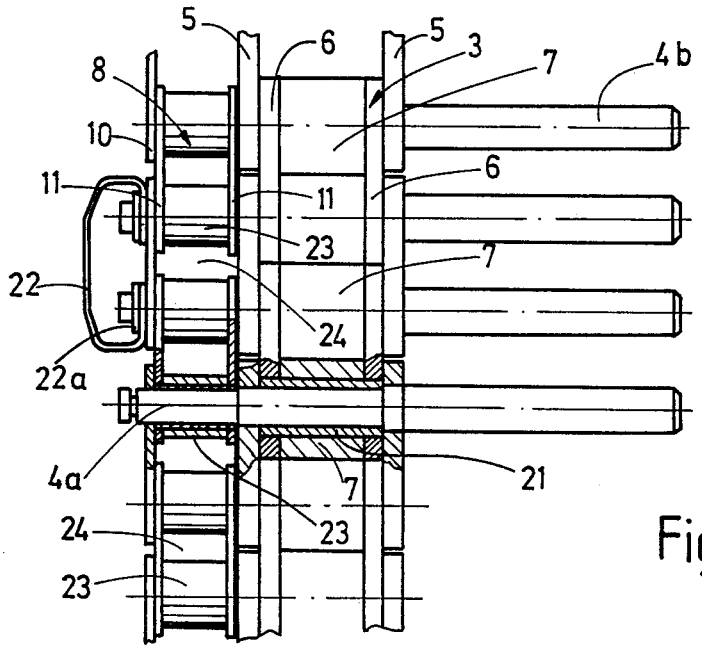
FIG. 2 is a top elevational view of the apparatus of FIG. 1.

It can be seen in FIGS. 1 and 2 that one of the press belts 1 (e.g., a steel belt) in a dual belt press is pressured by rolls 2 against the other belt in a pressure zone. The rolls 2 are abutting on the opposite side against press plates 20, which are conventional and may be heated. The belt (not shown) opposing the shown press belt 1 is supported in a similar fashion.

Each roll is connected to a first chain 3. That is, each roll 2 is provided with a blind bore 19 into which protrudes a first extension **4*b* of a chain stud 4 of the chain 3. The first extension includes a stop collar 12 of enlarged diameter, which abuts against the adjacent outer link plate 5 of a first pair of chain links 5, 6. The stud 4 passes through the chain links 5, 6 to the second pair 5, 6 of links on the other side and has a second extension 4*a* which protrudes from the second pair of chain links. The second pair of chain links is spaced from the first pair in a direction parallel to the longitudinal axis of the roll. In the area between the inner link plates 6 the stud carries a guide bushing 21, which bushing is longitudinally confined between the outer link plates 5. In the area between the two inner link plates 6 a sleeve 7 is inserted, the diameter of which is adjusted to the dimensions of the link plates 5 and 6 so that the circumferences of adjacent sleeves 7 are in contact with each other in the pressing zone of the belts (see FIG. 2). Each sleeve is longitudinally confined between the inner link plates 6. Provided on the second extension 4*a* of the stud 4 is a second chain 8 which comprises link plates 10, 11 of a smaller thickness. The additional link plates 10, 11 are secured to the end of the second extension 4*a* by conventional spring fasteners 22 and retaining rings 22*a*. Inserted in the area between the two inner link plates 11 of the additional linkage are rotatable sleeves 23, each of which forms a gap 24 with an adjacent sleeve 23. That gap 24 is arranged in a conventional manner such that a tooth 25 of a drive gear 9** may enter into it.

FIG. 1 shows that the drive gear 9 is part of a drive disk 18 joined fixedly to a shaft 26. A side 17 of the disk 18 facing away from the gear 9 has the configuration of a guide disk, the circumference of which rests against the sleeves 7. The guide disk 17 is contiguous with a connecting guide rail (not shown) which guides the sleeves 7 and thus the first chain 3.

As the sleeves 7 of the first chain 3 are in contact with each other at their circumferences, all of the lateral forces transmitted from the rolls 2 to the chain studs **4*b*, 4 are resisted, especially in the press zone. The term "lateral" as used herein refers to a direction extending laterally of the axes of the studs 4. The configuration may be such that the clearance of the chain 3 is very small. Due to the mutual contact of the sleeves 7, which may be made of an appropriately hardened material, any enlargement of this clearance in the course of the operation of the chain 3 may be largely prevented. Clearances may result from a wearing of the sleeves 7, but may be kept very small. The chain 3 thus effects a highly reliable lateral guidance of the rolls 2. Although the abutting relationship of the sleeves 7 prevents the chain 3 from being directly driven, this shortcoming is overcome by the provision of the chain 8, which is stable enough to absorb the forces generated. It is sufficient here to use standard chain links 10, 11 engaging the corresponding tooth gears. The chain links 10, 11 are physically weaker than the chain links 5, 6 of the first chain 3 since they function merely to transmit driving forces. Deformation of these chain links 10, 11 is prevented by the first chain 3**. The novel arrangement is therefore suitable for dual belt presses, which are designed to apply high pressures.

Figure 3:
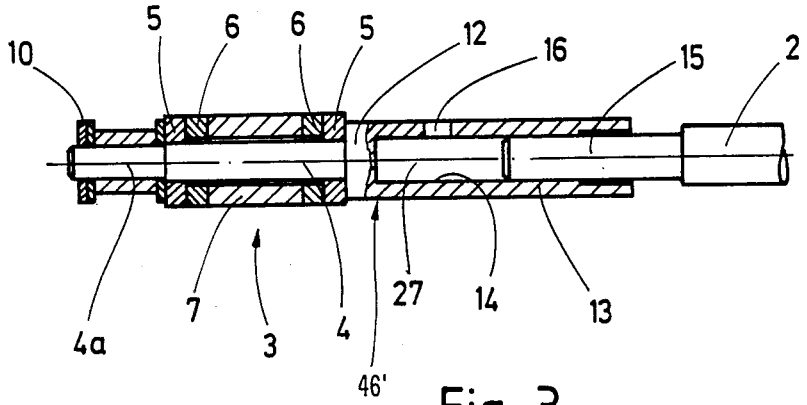
FIG. 3 is a sectional view similar to FIG. 1 of a modified form the invention.

FIG. 3 shows a modification to the extent that the chain stud 4 on the side facing the rolls 2 has a first extension 26' with a stop collar 12, and further includes a bore 14 into which extends a corresponding end journal 15 of the roll 2. A radial bore 16 is further provided through which the portion 27 of the bore 14 not occupied by the journal, may be filled with a lubricant. It was discovered that in this embodiment, the extension **4*b'* is highly stable in view of the larger diameter, and the stud is thus especially adapted to be equipped with the stable chain links 3 having adjacent sleeves 7**.

Figure 4:
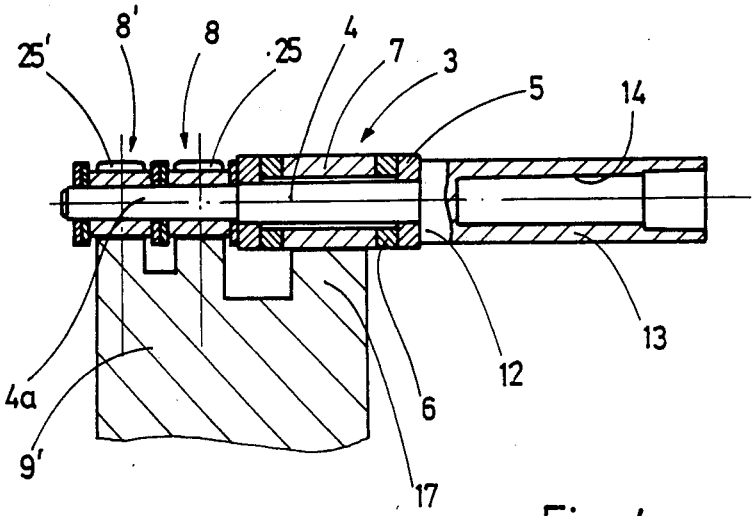
FIG. 4 is a sectional view similar to FIG. 1 of yet another embodiment.

FIG. 4 shows a further modification to the extent that a tooth gear 9' with two rows of teeth 25, 25' is provided, which teeth engage corresponding chains 8, 8' located parallel to each other in the area of the extension **4*a* of the chain stud 4. This embodiment has the advantage that the chains 8, 8' need to be only as strong as necessary to transmit the necessary driving forces. Another advantage is that the larger length dimension of the extension 4*a*** provides further stabilization relative to the tilting of the rolls.

Although the present invention has been described in connection with preferred embodiments thereof, it will be appreciated by those skilled in the art that additions, substitutions, modifications and deletions not specifically described, may be made without departing from the spirit and scope of the invention as defined in the appended claims.

What I claim is:

1. In a dual belt press of the type wherein two belts are each supported by a plurality of rotary rolls, means being provided for supporting each end of said rolls comprising a first chain including spaced chain links spaced apart in a direction parallel to a longitudinal roll axis, a stud passing through said chain links and operably connected to an associated roll, and a sleeve disposed on said stud between said chain links, adjacently disposed ones of said sleeves contacting one another at their circumferences, and a second chain operably connected to said first chain and adapted to be driven for displacing said rolls along a press zone of said press.

2. Apparatus according to claim 1, wherein said second chain is mounted on extensions of said studs.

3. Apparatus according to claim 2, wherein said second chain comprises chain links which are physically weaker than said chain links of said first chain.

4. Apparatus according to claim 3, wherein said stud includes a stop shoulder for bearing against an outer chain link of said first chain.

5. Apparatus according to claim 4, wherein said stud includes a bore which receives a journal connected to an associated roll.

6. Apparatus according to claim 5 including a radial bore communicating with said bore for admitting a lubricant to said bore.

7. Apparatus according to claim 1 including a guide member on which said first chain is guided.

8. Apparatus according to claim 7, wherein said guide member comprises a rotary disk, a portion of which drivingly engages said second chain.

9. Apparatus according to claim 1, wherein said second chain comprises spaced chain links spaced apart in a direction parallel to said longitudinal roll axis.

* * * * *